United States Patent [19]

Inubushi et al.

[11] Patent Number: 4,978,040

[45] Date of Patent: Dec. 18, 1990

[54] ROTARY NOZZLES

[75] Inventors: Hisao Inubushi; Tetsuya Yoshihara; Mioshi Sakamoto, all of Kanagawa, Japan

[73] Assignees: NKK Corporation, Tokyo; Nippon Rotary Nozzle Co., Ltd.; Kokan Kikai Kogyo Kabushiki Kaisha, both of Kawasaki; Tokyo Yogyo Kabushiki Kaisha, Tokyo, all of Japan

[21] Appl. No.: 356,784

[22] Filed: May 24, 1989

[51] Int. Cl.[5] ..... B22D 41/26

[52] U.S. Cl. ..... 222/598

[58] Field of Search ..... 222/598, 599; 266/236

[56] References Cited

U.S. PATENT DOCUMENTS 4,591,080 5/1986 Yoshihara ..... 222/598

*Primary Examiner*—Richard K. Seidel
*Assistant Examiner*—J. Reed Batten, Jr.
*Attorney, Agent, or Firm*—Ladas & Parry

[57] ABSTRACT

A rotary nozzle in which at least one coil spring is removed, acting to increase the clearance between a surface of the bottom plate brick and a surface of the slide plate brick. This mechanism is capable of improving the pushing force in the vicinity of the nozzle hole, and prevents molten steel leakage, thus prolonging the life of expensive bricks.

3 Claims, 4 Drawing Sheets

ROTARY NOZZLES

BACKGROUND OF THE INVENTION

1. Field of the Invention

This invention relates to a rotary nozzle, and more particularly to a molten steel leakage prevention device suitable for a rotary nozzle.

2. Description of the Prior Art

Rotary nozzle systems have been used widely with ladles for receiving the molten steel tapped from a converter to transport or pour the molten steel into molds, tundishes for receiving the molten steel from a ladle to pour the molten steel into molds and the like. In particular, the door type rotary nozzle in which can be pivoted so as to open by hinges of a rotor containing a slide plate brick, has been widely used due to its many advantages, i.e., the bottom plate brick and the slide plate brick can be exposed to permit the confirmation of any damages on the brick surfaces by the naked eye, that there is no need to prepare any standby set for replacing or repairing the bricks, that the operation is easy and so on.

In the door type rotary nozzle, the door is mounted pivotably at the base member fixing a bottom of a ladle by hinges with which the door is opened and closed. The door is required for safety control in that the bottom plate brick and the sliding plate brick have to be tightly sealed to each other to prevent molten steel leakage and air entrance during the closed condition. A secure locking system must guarantee the door does not open during operation.

FIG. 4 shows an example of the rotary nozzle. In FIG. 4, a base member (2) is fixed with bolts on a vessel (1) of a ladle or tundishes, and a bottom plate brick (3) is mounted on the base member (2). A top nozzle (5) penetrates the hole through the vessel (1) and the base member (2) of the bottom ladle and is met with the nozzle hole (4) of the bottom plate brick (3). An annular support frame (door) (6) is mounted by rotating it on the base member (2) with a hinge (7). A rotor (8) is housed in the annular support frame (6) and mounted by rotating it onto the movable support member (13) via a ball bearing (9). The rotor (8) also has a gear (10) on the outer periphery engaged with another gear (not shown) coupled to a driving source, and houses a slide plate brick (11) facing the bottom plate brick (3) in the upper portion. A collector nozzle (14) is coupled to the slide plate brick (11). Both the nozzle (4) of the bottom plate brick (3) and the nozzle bore (12) of the slide plate brick (11), are formed so as to shift by distance d from the center axis 0—0 of the bricks (3) and the nozzle bore (11) (see FIG. 5(*a*)). A spring seat (15) faces the movable support member (13) in the annular support frame (6), and is close mounted along the periphery of the rotor (8) (FIG. 5(*a*)). A coil spring (16) is placed between the movable support member (13) and the spring seat (15).

FIG. 5(*b*) shows a use of the brick (11*a*) in polygon surrounded by many coil springs (16) which the applicants of the present invention filed with the Japanese Patent Office on Nov. 18, 1985 as Japanese Patent Application No. 60-256703. In the above mentioned rotary nozzle, there is no possibility of molten steel leakage since the collector nozzle (14) is mounted to the rotor (8) in pouring, the annular support frame (6) is locked and fixed to the base member (2) with bolts, and both the bottom plate prior (3) and the slide plate brick (11) are tightly joined with each other by means of a repulsion of the coil spring (16), as seen in FIG. 4. If necessary, the pouring amount of molten steel can be controlled by rotating the rotor with a driving source and by adjusting an opening angle of the nozzles (4) and (16).

FIGS. 6 and 7 each are model diagrams explaining the mechanism of molten steel leakage in a prior art rotary nozzle. The rotary nozzle is mounted on the bottom portion of a ladle and injects molten steel into a molding machine, as described above. The edge portions of the nozzle (4) and (12) are melted and removed out in wedge shapes by high temperature molten steel (21) with a lapse of time. The molten steel enters and solidified in the wedge shape portions, as shown in FIG. 6(*a*). When the slide plate brick (11) is slide toward the arrow as shown in FIG. 6(*b*), the solidified molten steel remains without being smashed, and occurs a gap g between the sliding surfaces of both the bricks (3) and (11). This phenomenon is true even in the rotary nozzle. When the slide plate brick (11) is rotated to control pouring of molten steel as shown in FIG. 7, the solidified molten steel forcibly opens one end (near to the nozzle hole (12)) of the slide plate brick (11) against the coil spring (16) to form a gap g. In this case, the other end of the slide plate brick (11) works as a fulcram line a. As a result, the molten steel leaks through the gap g. This problem has required early repairs of the bricks (3) and (11) and early exchanges of expensive bottom plate bricks and slide plate bricks before an occurrence of the molten steel leakage. Elimination of these above mentioned disadvantages is a priority.

The object of the present invention is to provide an improved rotary nozzle which can prevent molten steel leakage out of the nozzle hole over a long period of time by removing a part of the coil springs.

SUMMARY OF THE INVENTION

An improved rotary nozzle according to the present invention comprising: a base member including a bottom plate brick having a nozzle hole formed at a shifted position from the center of the base member; a frame mounted so as to open and close the base member; a slide plate brick having a nozzle hole for meeting with the nozzle hole of the bottom plate brick and having gears formed on the peripheral surface; and a rotor housed in the frame and supported by many coil springs positioned around the rotor; the coil springs positioned at a distance from the nozzle hole of said bottom plate brick with a reduction of at least one coil spring.

In short, the force which works to separate the bottom plate brick and the slide plate brick is reduced by removing at least one coil spring positioned at the opposite side of the nozzle hole in the bottom plate brick. As a result, an improved closing force near the nozzle hole can prevent molten steel leakage from the nozzle hole.

DESCRIPTION OF A PREFERRED EMBODIMENT

Figure 7:
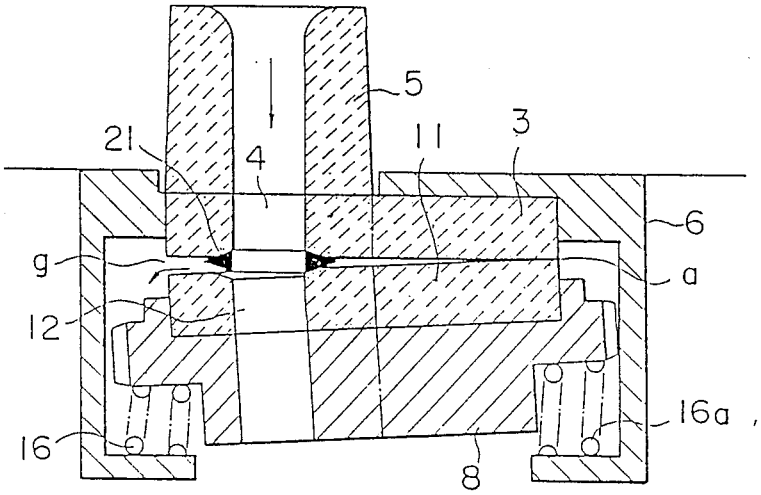
FIG. 7 PRIOR ART

The inventors of the present invention have researched and studied the aforementioned molten steel leakage mechanisms for a long period of time. We found that when a solidified molten steel (21) invades the damaged portions (20) formed by melting at the edges of the nozzle holes (4) and (12), the coil spring (16) near the nozzle hole (12) acts as a pushing or resistant force (positive force) against the slide plate brick (11), while the coil spring (16(*a*)) disposed at the opposite ends (shown as a fulcram line a) both of the bricks (3) and (11) acts as an opening (or separation) force (negative force) against the slide plate brick (11), as seen in FIG. 7.

Figure 1:
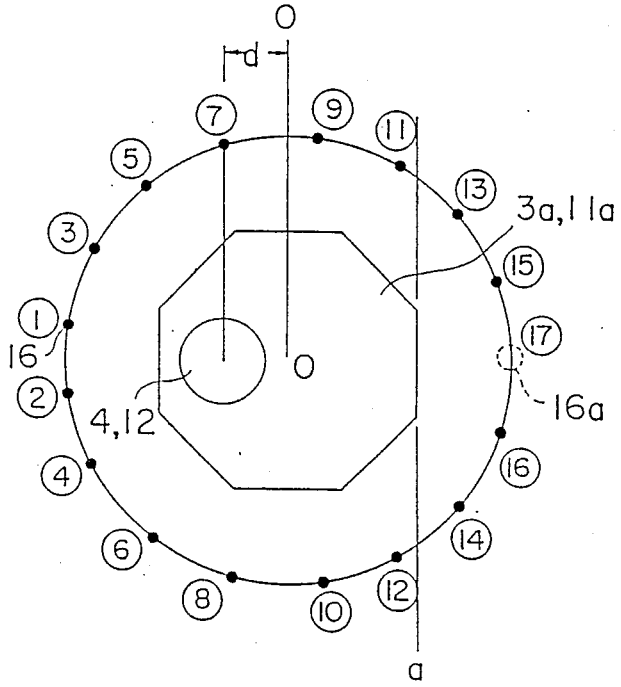
FIG. 1 is a view explaining the embodiment according to the present invention.
Figure 2:
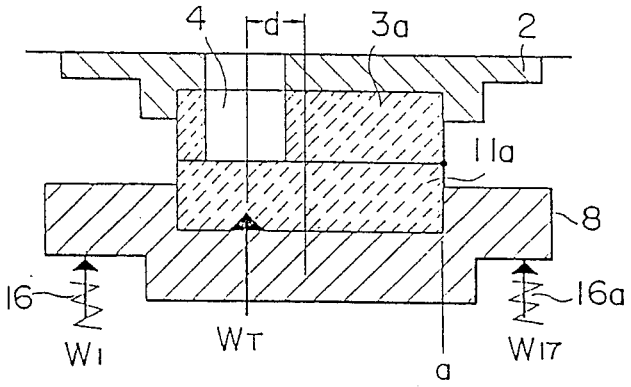
FIG. 2 is a diagram showing the relationship between the pushing force of a slide brick.
Figure 3:
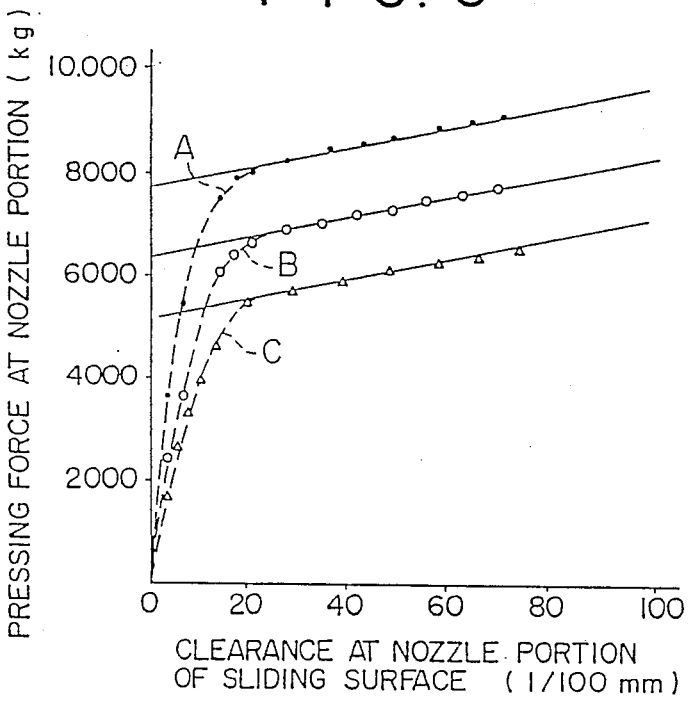
FIG. 3 is a graph showing the relationships between the pushing force at the nozzle hole and the number of coil springs and including the line (A) for 14 coil springs in case three coil springs are removed and the line (B) for 16 coil springs, in case one coil spring is removed and the line (C) for 17 coil springs in case no coil springs are removed.
Figure 4:
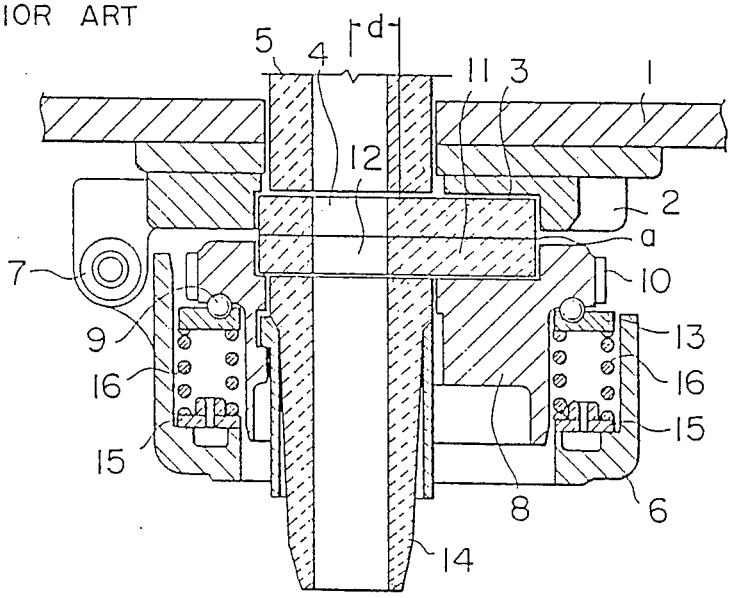
FIG. 4 PRIOR ART
FIG. 4 is a sectional view showing an example of a rotary nozzle according to the present invention.
Figure 5A:
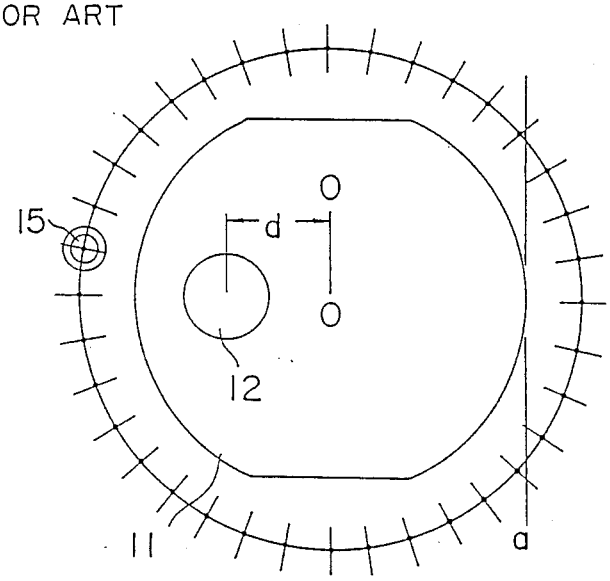
FIG. 5(a) PRIOR ART
FIGS. 5(*a*) and 5(*b*) are diagrams showing an arrangement of coil springs.
Figure 5B:
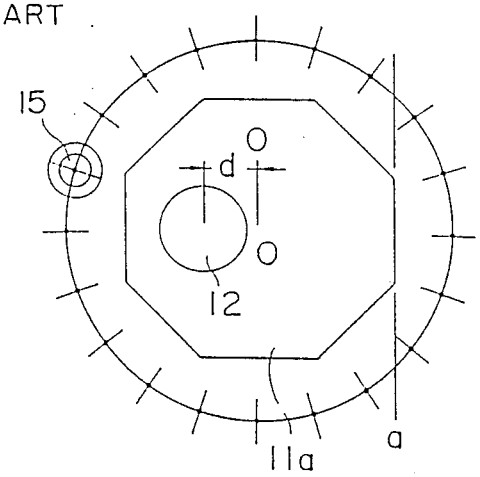
FIG. 5(b) PRIOR ART
Figure 6A:
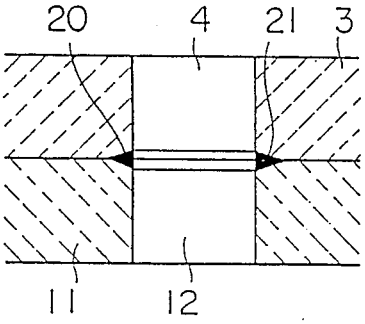
FIG. 6(a) PRIOR ART
FIGS. 6(*a*) and 6(*b*) and FIG. 7 each are diagrams explaining molten steel leakage mechanism of a nozzle hole.
Figure 6B:
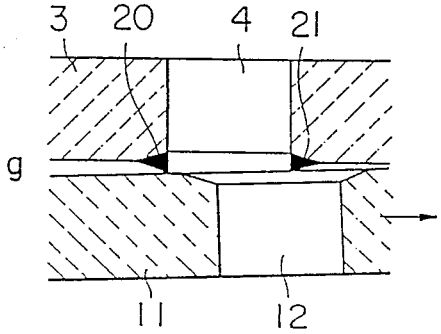
FIG. 6(b) PRIOR ART

FIG. 1 is a view explaining an example of the present invention, including the base member (2), the bottom plate brick, the slide plate brick, the nozzle holes (4) and (12), a rotor (8), and coil springs (16) and (16*a*). FIG. 2 is a diagram showing the relationships in the pushing forces of a slide plate brick. Seventeen coil springs numbered from 1 to 17 are arranged around the slide plate brick.

The coil springs are located toward the nozzle hole (12) from the fulcram line a and provide a positive force (shown with W in FIG. 2). This works with the slide plate brick (11*a*) as an opening force, to open the junction of the nozzle holes (4) and (12). The coil springs are located on the outside of the fulcram line and provide a negative opening force to the slide plate brick 11*a*. In FIG. (2), a pushing force WT shows a value obtained by converting a total pushing force of each of the coil springs to the pushing force at the nozzle (12).

The relationships between the number of the coil springs (16) and a total pushing force from the total coil springs and a pushing force WT at the nozzle (12) are shown in the following Table I.

TABLE I

| NUMBER OF COIL SPRINGS | TOTAL PUSHING FORCE OF COIL SPRINGS | PUSHING FORCE AT NOZZLE HOLE |
|---|---|---|
| 17 (Total) | 14,025 Kg | 10,313 Kg |
| 16 (removed one spring) | 13,200 | 10,537 |
| 14 (removed two springs) | 11,550 | 10,862 |

As indicated in the Table I, even if the number of the coil springs (16) decrease, the pushing force on the nozzle hole can be improved by removing a coil spring at a selected position (or a position on the outside of the fulcram line a). Conventionally, the coil springs (16) are equally arranged around the slide plate brick (11) and some of the bricks (3) and (11). According to this invention, a selective removal of coil springs improves the pressure around the nozzle hole, thus preventing molten steel leakage.

In the above embodiment, coil springs (16) are arranged around the slide plate brick (11), and a part of the coil springs (16) are disposed outward away from the fulcram line a are removed. However, the number of coil springs is not limited and at least one coil spring may be removed. Also, in the above embodiment, the spring seats are positioned around the rotor and some of coil springs are removed. However, some of the spring seats may be neglected from the first.

What is claimed is:

1. A rotary nozzle comprising:

a base member (2) having a bottom plate brick (3) which has a nozzle hole at a position shifted outward from the center of the brick;

a frame mounted to the base member which can be opened and closed;

a rotor having a slide plate brick with a nozzle hole for matching with the nozzle hole of the bottom plate brick and having gears on the periphery of the slide plate brick (11), and the rotor being supported at the periphery by a plurality of coil springs (16) and housed in the frame;

the coil springs being positioned around the slide plate brick, at a distance from the nozzle hole of the bottom plate brick, in a non-uniform sequence.

2. The rotary nozzle according to claim 1, wherein at least one of said coil springs is not positioned outward of a fulcrum line of both said bottom plate and said slide plate brick when molten steel (21) has solidified at edges of nozzles (4) and (12).

3. The rotary nozzle according to claim 1, wherein the coil springs are positioned so that at least one coil spring is not positioned by a side of the rotary nozzle opposite the nozzle hole in the bottom plate.

* * * * *